US008323063B2

(12) United States Patent
Mueller

(10) Patent No.: US 8,323,063 B2
(45) Date of Patent: Dec. 4, 2012

(54) WATERCRAFT DRIVE

(76) Inventor: Peter A. Mueller, Gattikon (CH)

( * ) Notice: Subject to any disclaimer, the term of this patent is extended or adjusted under 35 U.S.C. 154(b) by 0 days.

(21) Appl. No.: 11/989,483

(22) PCT Filed: Aug. 4, 2006

(86) PCT No.: PCT/CH2006/000411

§ 371 (c)(1),
(2), (4) Date: Jan. 25, 2008

(87) PCT Pub. No.: WO2007/016804

PCT Pub. Date: Feb. 15, 2007

(65) Prior Publication Data

US 2008/0261468 A1 Oct. 23, 2008

(30) Foreign Application Priority Data

Aug. 5, 2005 (CH) ..... 1302/05

(51) Int. Cl.
*B63H 3/00* (2006.01)

(52) U.S. Cl. ..... 440/50

(58) Field of Classification Search ..... 440/49, 440/50, 51, 61, 66, 71, 88 R–88 T, 89 R–89 J; 416/163

See application file for complete search history.

(56) References Cited

U.S. PATENT DOCUMENTS

| | | | | | |
|---|---|---|---|---|---|
| 2,415,183 | A | * | 2/1947 | Law | 440/62 |
| 3,589,204 | A | | 6/1971 | Langley | |
| 3,933,116 | A | * | 1/1976 | Adams et al. | 440/57 |
| 4,371,350 | A | | 2/1983 | Kruppa et al. | |
| 4,544,362 | A | * | 10/1985 | Arneson | 440/61 R |
| 4,645,436 | A | | 2/1987 | Sakamoto | |
| 4,645,463 | A | * | 2/1987 | Arneson | 440/57 |
| 4,790,782 | A | * | 12/1988 | McCormick | 440/61 R |
| 5,046,975 | A | | 9/1991 | Buzzi | |
| 5,863,230 | A | * | 1/1999 | Morrison | 440/61 R |
| 6,250,979 | B1 | | 6/2001 | Muller | |

FOREIGN PATENT DOCUMENTS

| | | |
|---|---|---|
| WO | WO 86/02901 A1 | 5/1986 |
| WO | WO 01/47770 A1 | 7/2001 |

* cited by examiner

*Primary Examiner* — Daniel Venne
(74) *Attorney, Agent, or Firm* — Oliff & Berridge, PLC

(57) ABSTRACT

A surface drive that includes a shaft housing; a propeller; a propeller shaft that passes through the shaft housing with the propeller mounted at an end of the propeller shaft; and mounted to the shaft housing is at least one of a container, wherein a self-locking or automatic locking pitch change mechanism that is configured to adjust a propeller blade of the propeller is partially located in the container, or a propeller ventilation unit that is configured to direct exhaust gas to or away from the propeller based on a travel condition of the surface drive.

12 Claims, 5 Drawing Sheets

WATERCRAFT DRIVE

BACKGROUND

The invention relates to a surface drive that is attached to the stern of a watercraft.

Drives attached to the sterns of watercraft are relatively well-known; they include sterndrives and surface drives. The main difference between the two systems, for example, is that the engine exhaust outlet has to be behind the propeller in sterndrives. When the surface propeller rotates and the propeller is fully submerged, the engine exhaust gas is supposed to be in front of the propeller blades for propeller ventilation (see, for example, U.S. Pat. No. 5,046,975). Moreover, for sterndrives, the propeller thrust is transferred to an underwater unit via axial bearings and to the watercraft in part via trim cylinders and in part via an above-water unit (see, for example, U.S. Pat. No. 3,589,204). For surface drives, the propeller thrust affects the rear of the watercraft, directly in the case of rigid drives and directly in the case of pivoting drives (see, for example, U.S. Pat. No. 4,645,463).

Furthermore, an appropriate distance is needed between the propeller of the surface drive and the stern of the watercraft. An appropriate distance is needed because the efficiency of the propeller when the watercraft travels in reverse declines the closer the propeller is located to the stern of the watercraft because a part of the propeller circumference directs the propeller thrust directly against the stern of the watercrart, thus resulting in a flow loss. A technical solution to this problem can be found in U.S. Pat. No. 4,371,350.

The introduction of a controllable-pitch propeller is problematic in that there is not as much space available in a surface drive as there is in sterndrives as described in U.S. Pat. No. 6,250,979. In addition, a hollow shaft design is required for large seagoing vessels (see, for example, WO 8602901), which incurs a high cost. Moreover, the successive changes in load impacting the adjustment mechanism at each blade immersion and emergence for each revolution of the propeller is considerable due to the changes in spindle force applied to the propeller blades when they rotate about a hub. This necessitates a rigid structure and a safe and secure blade location should the hydraulic system fail.

SUMMARY

The invention is based on the above concerns, and relates to a surface drive for a watercraft. In particular, the invention is directed to attaching a self-locking or automatic locking pitch change mechanism for a controllable-pitch propeller with a sensor in order to prevent any uncontrolled change in propeller pitch or trim in the case of a sudden failure of the hydraulic cylinder. In addition, the design of the shaft housing and the flaps fitted to the side of the shaft housing are improved in order to achieve improved hydrodynamic buoyancy and water spray channeling characteristics and to enhance the maneuverability of the watercraft. Furthermore, the flow of exhaust gases changes based on whether the surface drive is used to drive the watercraft forward or reverse, or whether the watercraft is maintained at a neutral position (i.e., a travel condition of the surface drive), wherein the watercraft does not travel forward or in reverse (i.e., travel conditions of the surface drive).

BRIEF DESCRIPTION OF THE DRAWINGS

Various exemplary aspects of the invention will be described with reference to the drawings, wherein.

DETAILED DESCRIPTION OF EMBODIMENTS

Figure 1:
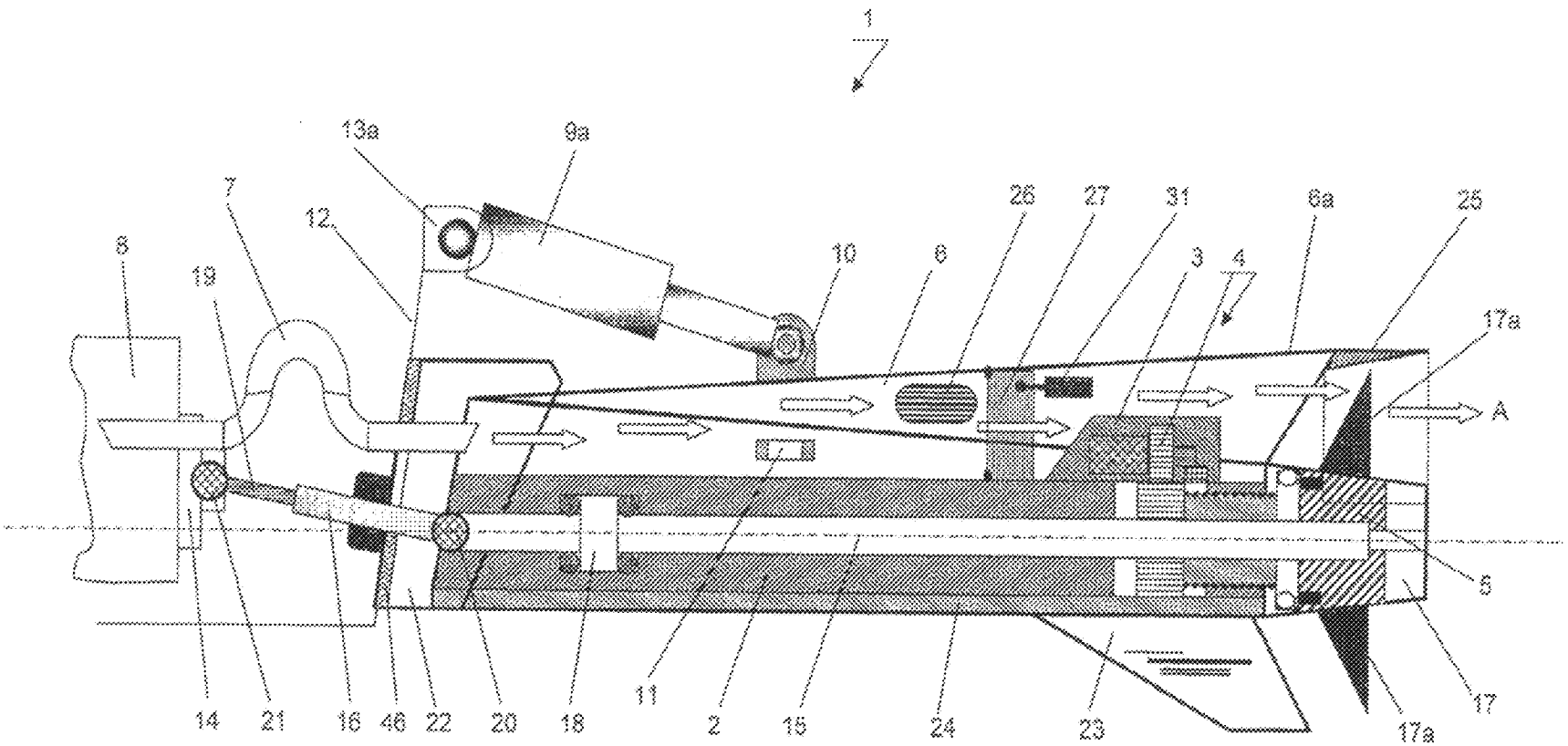
FIG. 1 is a schematic, side cross-section of a ship drive.

FIG. 1 shows a schematic, side cross-section of a ship drive, specifically the surface drive 1. The surface drive 1 includes a shaft housing 2 and a container 3 in which part of a pitch change mechanism 4 for activation of a mechanism 5 used to adjust the propeller is located. The container 3 is an easily accessible element that is watertight when closed and connected to the shaft housing 2. The container 3 is designed such that engine exhaust and coolant extraction A (which are examples of a flow that are drawn out of the surface drive 1) can occur in an unimpeded manner via duct 6 of the duct housing 6*a*. Engine exhaust and coolant extraction A occurs from an engine 8 into the duct 6 via an exhaust manifold 7. Pivot cylinders 9*a*, 9*b* for articulating the surface drive 1 are attached to an upper mounting 10 and a side mounting 11 on one side, and to mountings 13*a*, 13*b* on the watercraft stern 12 on the other side. The pivot cylinder 9*a* is used to trim the surface drive 1 and vary the amount by which the propeller blades 17*a* are immersed in the water.

Figure 2:
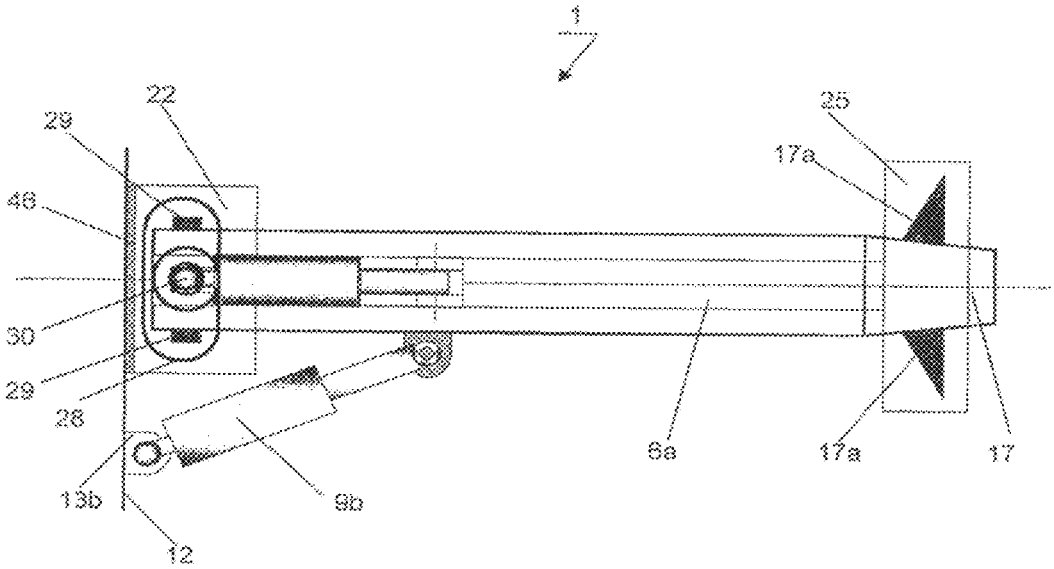
FIG. 2 is a schematic, top view of a ship drive.

The engine drive output is transferred either directly to propeller shaft 15 via gear 14 or to the propeller 17 via a second drive shaft 16. The propeller shaft 15 is mounted in the shaft housing 2 and the thrust forces generated by the propeller 17 are transferred to the axial bearing package 18 and transferred to the shaft housing 2. The thrust forces of the propeller 17 are transferred into a housing 22 via bearing pins 29 and a pivot pin 30, as shown in FIG. 2, and passed on to the watercraft stern 12 via elastic damping elements 46.

The drive shaft 16 is equipped with a length compensation element 19 (e.g., piston) and a second cardan or homo-kinetic joint 21 (e.g., constant velocity joint). The drive shaft 16 further dampens the vibration of the drive, and allows the engine 8 to be positioned at more locations.

Moreover, the shaft housing 2 is equipped with a guard 23 as well as a hydrodynamic buoyancy area 24, which is an enclosed area that helps to maintain the shaft housing 2 afloat. The buoyancy area 24 functions like a trim tab when the watercraft accelerates and helps the bow of the watercraft to lower as quickly as possible in order to ultimately position the watercraft at a shallow and a favorable angle of travel. The surface propellers 17 spray water when the propellers 17 rotate. A propeller cover 25 is fitted to the duct housing 6*a* in order to effectively reduce the extent by which the water is sprayed. The propeller cover 25 can be shaped to be an arch-shaped tunnel, a simple T shape or a similar shape. In the event that the duct housing 6*a* is made of a synthetic material, the propeller cover 25 can also be fitted directly to the container 3 via a flange element 25*a* or can be an integral component of a cover of a side flap.

In order to improve the harbor maneuverability of a watercraft with the surface drive 1, the engine exhaust and coolant extraction A is redirected when the watercraft moves in reverse (which is one of the driving conditions that also include a forward direction and a neutral position). The engine exhaust and coolant extraction A is redirected through a side duct 26 via a reversing flap 27, which are moved together via an adjustment unit 31 (e.g., piston) when the control lever for the reverse gear or blade pitch for reverse thrust is operated.

FIG. 2 shows a schematic, top view of the surface drive 1, the duct housing 6*a*, the propeller 17, and the propeller cover 25, as well as the pivot cylinder 9*a* for trimming and the pivot cylinder 9*b* for steering the watercraft via the horizontal movement of the surface drive 1. A pivot and hoist frame 28 is located in the housing 22. The bearing pins 29 trim the surface drive 1 and absorb the thrust that the surface drive 1 generates, and the pivot pin 30 is used for side pivoting and to absorb the thrust from the surface drive 1. The first cardan or homo-kinetic joint 20 (e.g., constant velocity joint) is located centrally to pivot and hoist the frame 28 and the bearing pins 29 and the pivot pins 30 that are accommodated in the housing 22 and are used for the low-friction pivoting of the surface drive 1.

Figure 3:
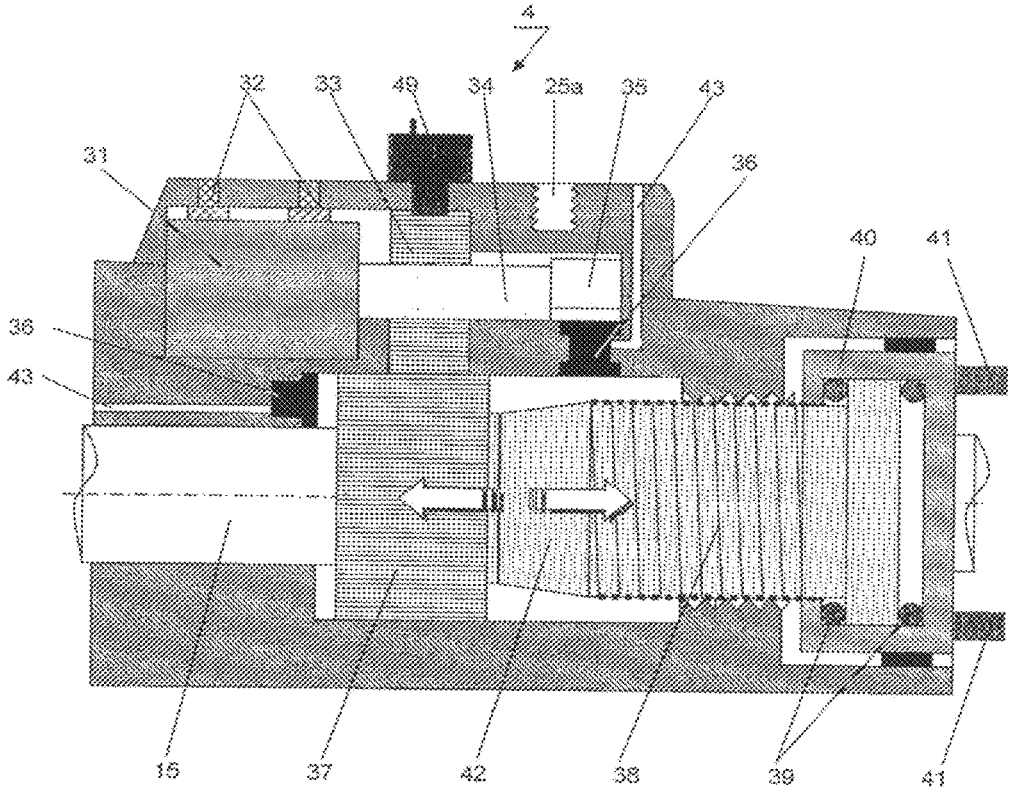
FIG. 3 is a schematic cross-section of the pitch change mechanism.

FIG. 3 shows a schematic cross-section of the pitch change mechanism 4 integrated in the shaft housing 2. An adjustment unit 31, for example a hydraulic or electric motor or a linear drive with a rack or similar activated drive via an angle gear, drives a shaft 34 that is connected to a gear wheel 33 and an eccentric cam 35. With a turn of the shaft 34 and the eccentric cam 35, the distance between the eccentric cam 35 and a sensor 36 adjacent to the eccentric cam 35 changes. The sensor 36 measures the distance between the eccentric cam 35 and the sensor 36 such that the distance between the eccentric cam 35 and the sensor 36 can be logged electrically.

The gear wheel 33 drives a gear wheel 37, which is larger than the gear wheel 33 and is connected to a self-locking spindle 38. The spindle 38 is self-locking (thus creating a self-locking pitch change mechanism 4) because of the thread pitch of the spindle 38. An adjustment axial bearing 39 is located at the end of the spindle 38. A mechanical link via the connection element 41 attached to the axial housing 40 to the adjustment mechanism 5 of the propeller 17 is thus assured in order to change the pitch of the propeller 17. The parts 37, 38 and 39 are hollow inside such that the propeller shaft 15 is mounted and can rotate without contact. The gear wheel 33 is axially supported without any play if possible, while the gear wheel 37, the spindle 38, the adjustment axial bearing 39, the axial housing 40 and the connection element 41 move axially when the gear wheel 33 rotates by being driven by the adjustment unit 31 via the shaft 34 as indicated by the arrows.

The spindle 38 is fitted with a cone 42. As should be appreciated, when the cone 42 moves axially as indicated by the arrows, the distance between the cone 42 and the sensor 36 changes. The cone 42 can thus be used instead of the eccentric cam 35. The sensor 36 can also be used in the shaft housing 2 to the side of the gear wheel 37 in order to measure changes in distance between the gear wheel 37 and the sensor 36 when the gear wheel 37 moves axially as indicated by the arrows. The gear wheel 38 can thus be used instead of the eccentric cam 35. All of the sensors 36 are positioned to the side of the propeller shaft 15.

The container 3, in which parts of the pitch change mechanism 4 are located, is also used as a flange element 25*a* for the mounting propeller cover 25. The container 3 also houses a line 32 connected to the adjustment unit 31 and a line 43 connected to the sensor 36.

The pitch change mechanism 4 is used to set the pitch of the propeller blades 17*a* and the pitch change mechanism 4 is self-locked or automatically locked. As discussed above, the pitch change mechanism 4 is self-locked because of the thread pitch of the spindle 38. The pitch change mechanism 4 can also be automatically locked using a worm gear or via a locking unit that locks the propeller blades 17*a* until a different pitch of the propeller blades 17*a* is used. For example, a side lock 49 (which is an example of a locking device) includes a pin that is inserted into the gear wheel 33.

Figure 4A:
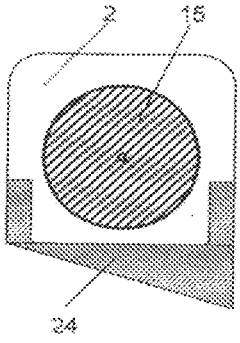
FIGS. 4*a*-4*c* are schematic, rear-view cross-sections through the ship drive.
Figure 4C:
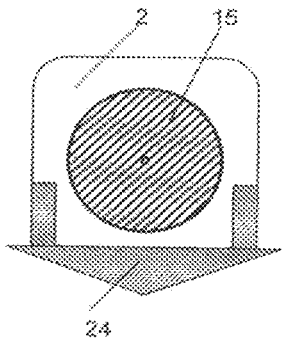
Figure 4B:
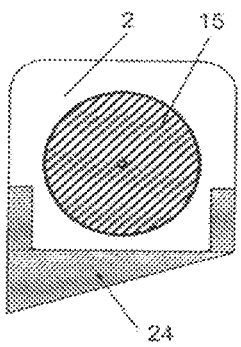

FIGS. 4*a*-4*c* show a schematic, rear-view cross-section through the shaft housing 2 with various flange-mounted, hydrodynamic buoyancy areas 24 that, with one and the same shaft housing design, can be completed a) for port, b) for starboard and c) for a single drive via the hydrodynamic buoyancy areas. The areas can thus be configured quickly and inexpensively for the various watercraft types and uses, i.e., with slimmer or broader areas, shorter or longer versions. The buoyancy areas 24 enable the watercraft to remain at a stable position in rough water as well as reduce bow rise when the watercraft accelerates from a standing position.

Figure 5:
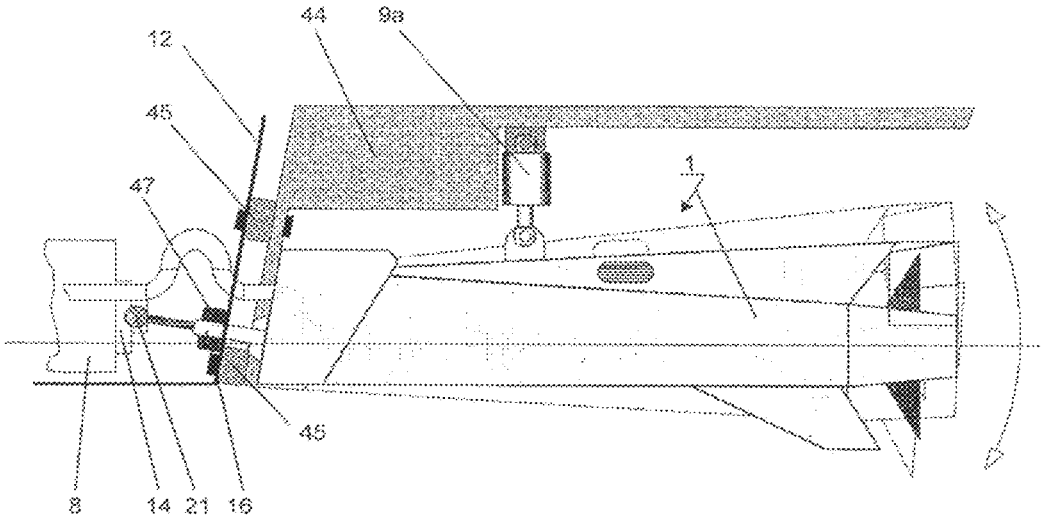
FIG. 5 is a schematic, side cross-section of a ship drive.

FIG. 5 shows a schematic, side cross-section through the surface drive 1 in a stern unit 44, which is connected to the watercraft stern 12 via elastic vibration and damping elements 45, whereby the pivot cylinders 9*a*, 9*b* are fitted to the stern unit 44. Via the installation of the entire surface drive 1 in the stern unit 44, the absorption of vibrations impacting on the watercraft between the watercraft stern 12 and the stern unit 44 is achieved by way of the vibration and damping elements 45, particularly if use is made of the second joint 21 and the corresponding drive shaft 16, such that the engine 8 can be supported in an appropriately comfortable manner. Any movement of the drive shaft 16 that may occur can be cushioned via an appropriate seal element 47 such as a shock absorber and a standard shaft seal.

Figure 6:
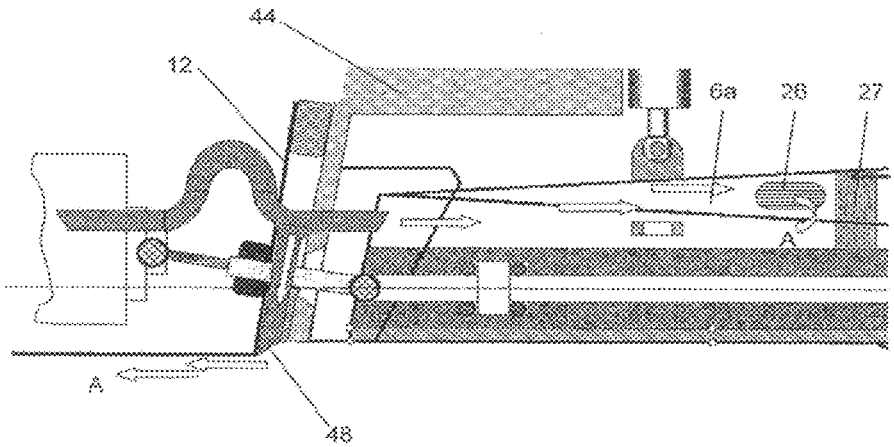
FIG. 6 is a schematic, side cross-section of a ship drive.

FIG. 6 shows a schematic, side cross-section through the surface drive 1 that is located in the stern unit 44, whereby, during reverse maneuvers, engine exhaust and coolant extraction A occurs through the side duct 26 in the duct housing 6*a* via the reversing flap 27 that is adjustable because of the adjustment unit 31. The engine exhaust and coolant extraction A occurs between the watercraft stern 12 and the stern unit 44 by way of an outlet duct 48.

As a result, the propeller 17 is not blown on during reverse travel. The reversing flap 27 is connected via a propeller reversing unit coupling (not shown) or reversing gear. The outlet duct 48 can also be used for normal travel as it ventilates the underwater part of the stern unit 44, thereby reducing its frictional resistance in the water. Moreover, the Venturi effect can also be achieved in this way, thus helping to make the extraction of engine exhaust more effective.

Figure 7:
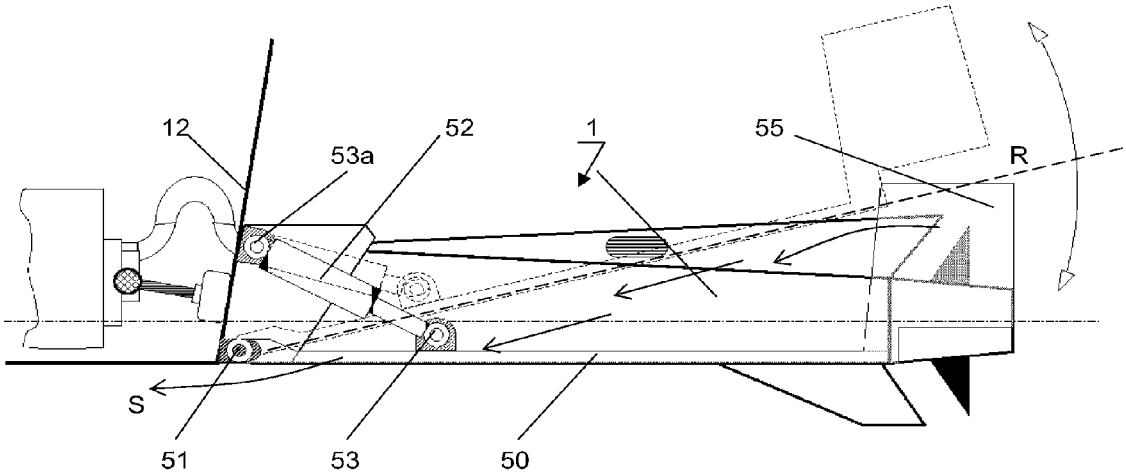
FIG. 7 is a schematic visualization of the flap system in a lowered and raised state.

FIG. 7 shows a schematic visualization of the side flap 50 with the cover 55 in a flat and hence travel and resting position as well as in the raised position R used for reversing. As an individual element to the left or right of the surface drive 1 or as a one-part element with an appropriate opening or covering of the shaft housing 2, the valve can be mounted directly on the shaft housing 2 or on the watercraft stern 12 or on the stern unit 44 via pivoting elements 51. The side flap 50 acts as an additional hydrodynamic buoyancy element, as a water spray guard due to the water swirled up by the propeller blades 17*a* when they emerge from the water and as a propeller thrust flow deflector located underneath the watercraft when the watercraft reverses. Operation of the side flap 50 occurs via a hoist mechanism 52 that is fitted to the shaft housing 2, the housing 22, the watercraft stern 12 or the stern unit 44 via a link unit 53*a* and to a flap bracket 53.

Hoist activation of the side flap 50 occurs via the coupling to the propeller reverse control (not shown) or to the reverse gear by way of the reverse lever located on the helm controls. If the side flap 50 is mounted directly on the shaft housing 2, the side flap 50 moves when the surface drive 1 is trimmed or steered.

The invention is, of course, not restricted to the application shown and described above.

The invention claimed is:

1. A surface drive, comprising:

a shaft housing;

a propeller;

a propeller shaft that passes through the shaft housing with the propeller mounted at an end of the propeller shaft; and mounted to the shaft housing is at least one of:

a container, wherein a self-locking or automatic locking pitch change mechanism that is configured to adjust a propeller blade of the propeller is partially located in the container, or a propeller ventilation unit that is configured to direct exhaust gas to or away from the propeller based on a travel condition of the surface drive.

2. The surface drive according to claim 1, wherein the pitch change mechanism is mounted to the shaft housing.

3. The surface drive according to claim 2, wherein the pitch change mechanism comprises a thread gear or a worm gear.

4. The surface drive according to claim 2, wherein the pitch change mechanism comprises a locking device that prevents the pitch change mechanism from adjusting the propeller blade of the propeller.

5. The surface drive according to claim 2, wherein the pitch change mechanism is equipped with an adjustment unit and a sensor.

6. The surface drive according to claim 5, wherein the adjustment unit is a fluid or electric motor or a linear drive.

7. The surface drive according to claim 2, wherein the pitch change mechanism is located between a joint of a drive shaft and the propeller.

8. The surface drive according to claim 2, wherein the pitch change mechanism is equipped with an opening for the propeller shaft.

9. The surface drive according to claim 2, wherein the pitch change mechanism is configured to adjust a pitch of the propeller blade.

10. The surface drive according to claim 2, wherein the pitch change mechanism is configured to adjust a pitch of the propeller blade such that the surface drive can travel in a forward direction and a reverse direction and rest remain in a neutral position.

11. The surface drive according to claim 2, wherein the pitch change mechanism is a self-locking pitch change mechanism with a self-locking adjustment thread that locks a desired pitch of the propeller blade.

12. The surface drive according to claim 1, wherein the propeller ventilation unit is mounted to the shaft housing, and the propeller ventilation unit includes:

a duct housing;

a reversing flap located within the duct housing; and a side duct connected to the duct housing, wherein the propeller ventilation unit is configured to have the reversing flap direct the exhaust gas to the side duct and away from the propeller when the surface drive travels in reverse.

* * * * *